US007506957B2

(12) United States Patent
Zhao

(10) Patent No.: US 7,506,957 B2
(45) Date of Patent: Mar. 24, 2009

(54) PRINTER WITH PRINT HEAD CLEANING FUNCTION

(75) Inventor: Ming-Jie Zhao, Shawo Township, Dongming County (CN)

(73) Assignee: Qisda Corporation, Taoyuan County (TW)

( * ) Notice: Subject to any disclaimer, the term of this patent is extended or adjusted under 35 U.S.C. 154(b) by 337 days.

(21) Appl. No.: 11/501,114

(22) Filed: Aug. 9, 2006

(65) Prior Publication Data

US 2007/0035577 A1 Feb. 15, 2007

(30) Foreign Application Priority Data

Aug. 10, 2005 (TW) ..... 94127222 A

(51) Int. Cl.
*B41J 2/165* (2006.01)

(52) U.S. Cl. ..... 347/23; 347/22; 347/32

(58) Field of Classification Search ..... 347/8, 347/14, 22–37, 104; 400/48, 55–60
See application file for complete search history.

(56) References Cited

U.S. PATENT DOCUMENTS

| | | | | |
|---|---|---|---|---|
| 5,394,178 | A * | 2/1995 | Grange | 347/32 |
| 5,847,728 | A * | 12/1998 | Lee | 347/33 |
| 6,733,102 | B2 * | 5/2004 | Hosono | 347/14 |
| 6,886,897 | B2 * | 5/2005 | Park | 347/8 |
| 7,101,096 | B2 * | 9/2006 | Sasai et al. | 400/48 |

* cited by examiner

*Primary Examiner*—Shih-wen Hsieh

(57) ABSTRACT

A printer with print head cleaning function is provided. The printer includes a housing, a round shaft, a carrier and a clean housing. The round shaft is disposed in the housing. The carrier is reciprocally disposed on the round shaft. The carrier is used for carrying one cartridge of the printer. The clean housing is equipped with a cleaner, which is used for cleaning one print head of the cartridge. When the carrier moves upward or downward, the carrier mechanically drives the clean housing to move upward or downward to maintain a fixed interference distance between the cleaner and the print head for enabling the cleaner to clean the print head and maintain the printing quality.

13 Claims, 13 Drawing Sheets

PRINTER WITH PRINT HEAD CLEANING FUNCTION

This application claims the benefit of Taiwan application Serial No. 94127222, filed on Aug. 10, 2005, the subject matter of which is incorporated herein by reference.

BACKGROUND OF THE INVENTION

1. Field of the Invention

The invention relates in general to a printer, and more particularly to a printer with print head cleaning function.

2. Description of the Related Art

Referring to both FIG. 1A and FIG. 1B. FIG. 1A illustrates a side view of a cartridge and a document feeder of a printer, while FIG. 1B illustrates a partly enlarged diagram of FIG. 1A. The printer 100 includes a housing 101, a shaft 103, a carrier 105 and a document feeder. The carrier 105 is disposed on the shaft 103. The carrier 105 reciprocates along the shaft 103. The document feeder includes a roller 102*a* and a roller 102*b*. When the printing paper 140 is sent to the position shown in the diagram through the document feeder, the roller 102*a* and the roller 102*b*, the print head 110 of the cartridge 109 has a pen-to-paper space (PPS) with respect to the paper 140. If the PPS is not a fixed value, then the ink of the print head 110 will not be uniformly spread over the paper 140. Therefore, a constant PPS is crucial to assuring the printing quality of the printer 100. However, the thickness of the printing paper is not always the same. For example, the Plain Paper typically has a thickness of 0.12 mm, while the Photo Paper typically has a thickness of 0.25 mm. In order to maintain a constant PPS so that the printing quality of the printer 100 can be assured, the cartridge 109 has to be adjusted according to the thickness of the printing paper.

A printer adopting an eccentric shaft is disclosed in Japan Patent Publication No. JP2001-047688. The print head is adjusted according to the thickness of the printing paper. By rotating the eccentric shaft to the corresponding position, the carrier moves upward or downward correspondingly for the PPS to be maintained fixed so that the printing quality of the printer is assured. However, it is difficult and costive to control the eccentric distance precisely.

Referring to FIG. 1A and FIG. 1B again. If only the height of the carrier 105 and the height of the cartridge 109 are raised up, a number of problems would occur. For example, the print head 110 of the cartridge 109 needs to be cleaned after a period of service. If the height of the cleaner (not shown in the diagram) used for cleaning the print head 110 is not raised up, the print head 110 would not be cleaned thoroughly. The reason is that an optimum interference distance exists between the print head 110 and the cleaner, and the cleaning quality will be affected if the distance between the print head 110 and the cleaner is larger or smaller than the interference distance. Currently, examples of resolving the change in the interference distance include United State Patent Publication No. US20030122892, which maintains a fixed interference distance between the cleaner and the print head by a device such as a relay for instance. Such practice is an electronic control, and would further increase the cost.

SUMMARY OF THE INVENTION

It is therefore an object of the invention to provide a printer which is dispensed with any electronic adjustment and capable of maintaining a fixed interference distance between the cleaner the cleaner and the print head for enabling the cleaner to clean the print head.

The invention achieves the above-identified object by providing a printer. The printer includes a housing, a round shaft, a carrier and a clean housing. The round shaft is disposed in the housing. The carrier is reciprocally disposed on the round shaft. The carrier is used for carrying one cartridge of the printer. The clean housing is equipped with a cleaner, which is used for cleaning one print head of the cartridge. When the carrier moves upward or downward, the carrier mechanically drives the clean housing to move upward or downward to maintain a fixed interference distance between the cleaner and the print head for enabling the cleaner to clean the print head and maintain the printing quality.

Other objects, features, and advantages of the invention will become apparent from the following detailed description of the preferred but non-limiting embodiments. The following description is made with reference to the accompanying drawings.

DETAILED DESCRIPTION OF THE INVENTION

First Embodiment

Figure 1A:
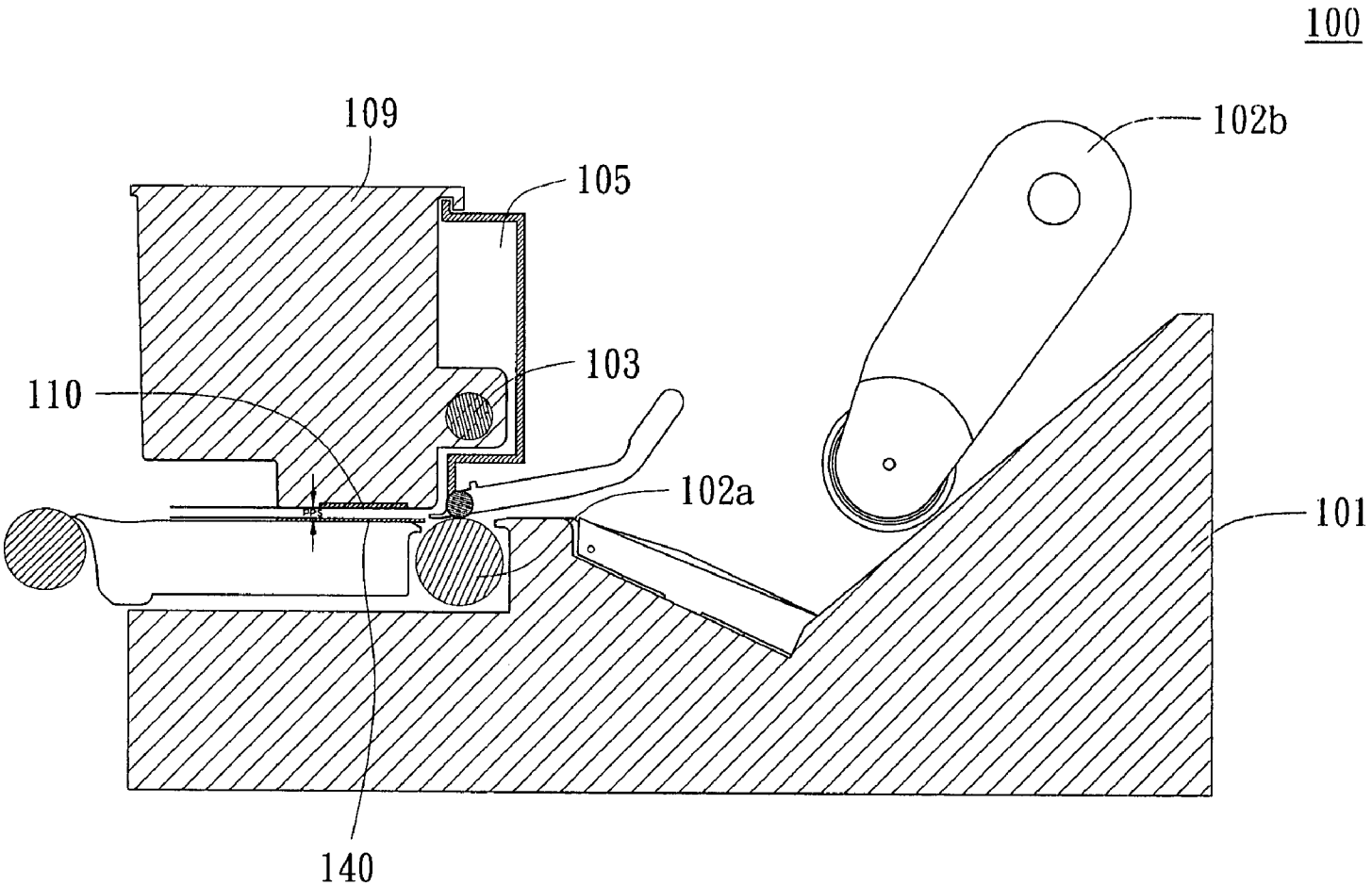
FIG. 1A(PRIOR ART)
FIG. 1A (Prior Art) illustrates a side view of a cartridge and a document feeder of a printer.
Figure 1B:
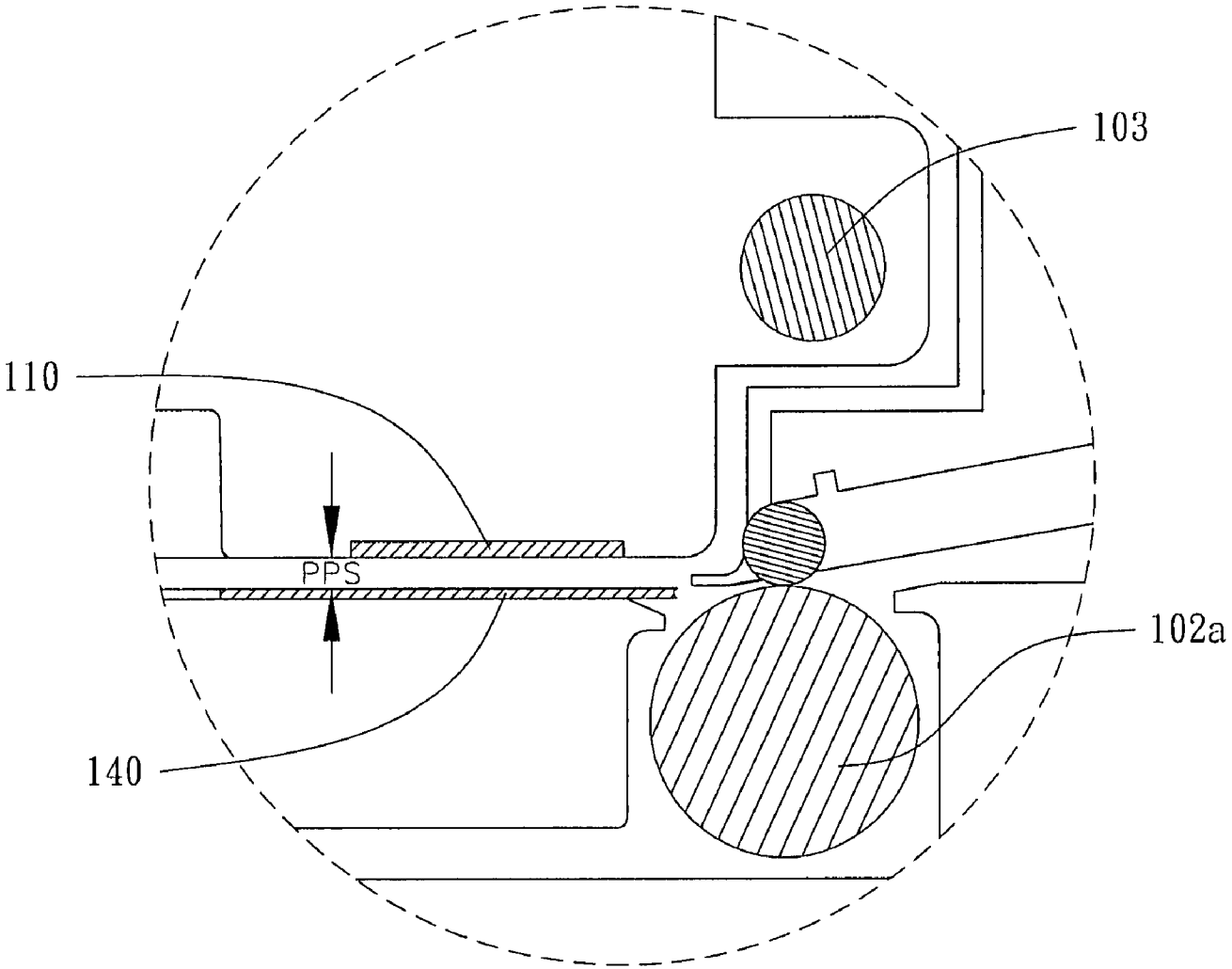
FIG. 1B(PRIOR ART)
FIG. 1B (Prior Art) illustrates a partly enlarged diagram of FIG. 1A.
Figure 2A:
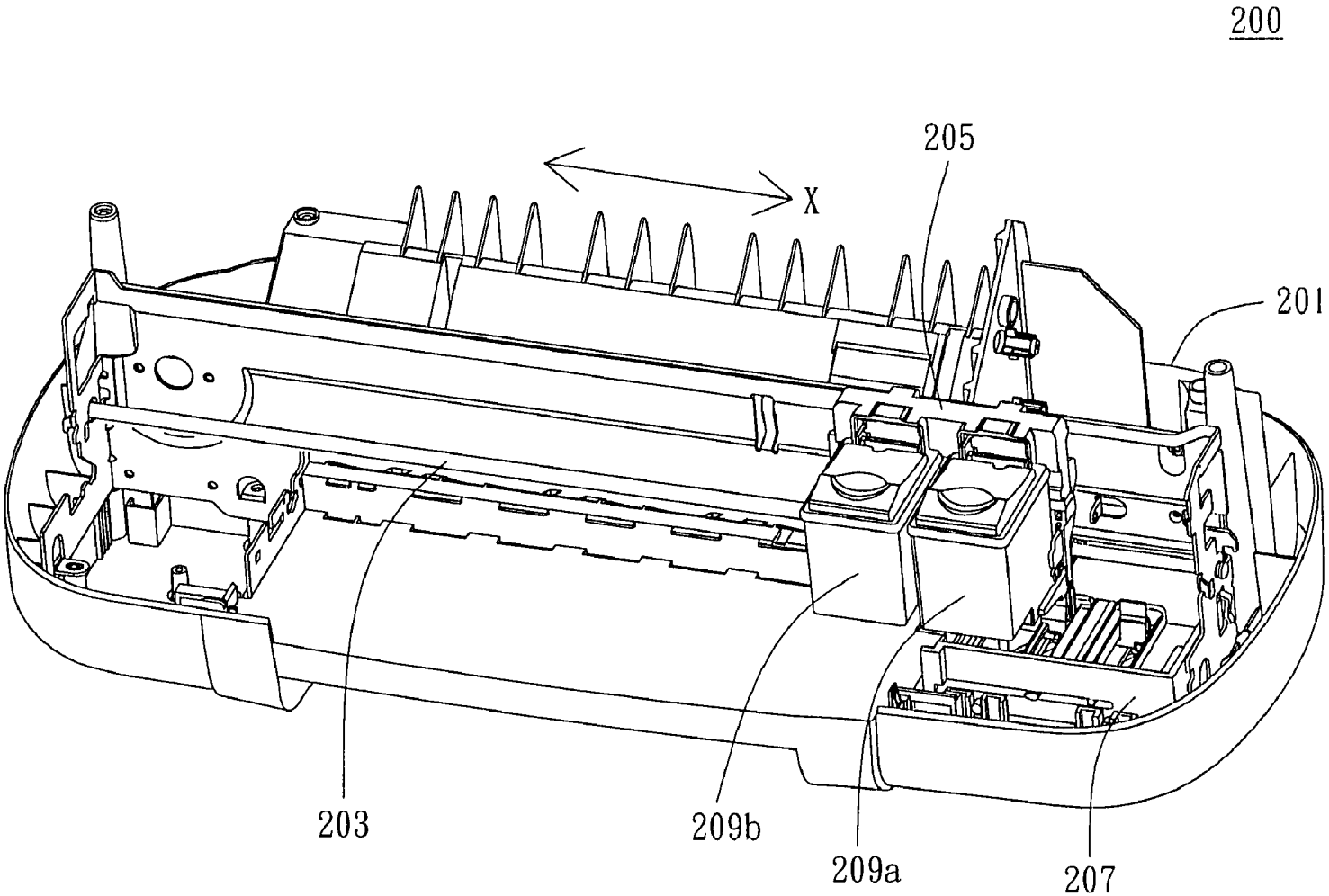
FIG. 2A illustrates an exploded diagram of a printer.

Referring to FIG. 2A, an exploded diagram of a printer is shown. The printer 200 includes a housing 201, a round shaft 203, a carrier 205 and a clean housing 207. The round shaft 203 is disposed in the housing 201, and is extended along an X direction. The carrier 205 has a pipe 211 disposed thereon (as shown in FIG. 2D). The pipe 211 is disposed on the round shaft 203 to drive the carrier 205 to reciprocate along the round shaft 203, so that the cartridge of the printer 200 such as cartridges 209*a* and 209*b* also reciprocate with the carrier 205. When the carrier 205 carries the cartridge to the position shown in FIG. 2A along the X direction, the carrier 205 drives the clean housing 207 for enabling the cleaner disposed on the clean housing 207 to clean the print head disposed on the cartridge. In order to match with various thicknesses of the printing paper, the height of the carrier 205 has to be adjusted accordingly. Therefore, the height of the clean housing 207 also has to be adjusted accordingly together with the adjustment of the carrier 205. As for how the carrier 205 drives the clean housing 207 and keeps a fixed distance between the clean housing 207 and the carrier 205 for enabling the cleaner disposed on the clean housing 207 to effectively clean the print head is disclosed below.

Figure 2B:
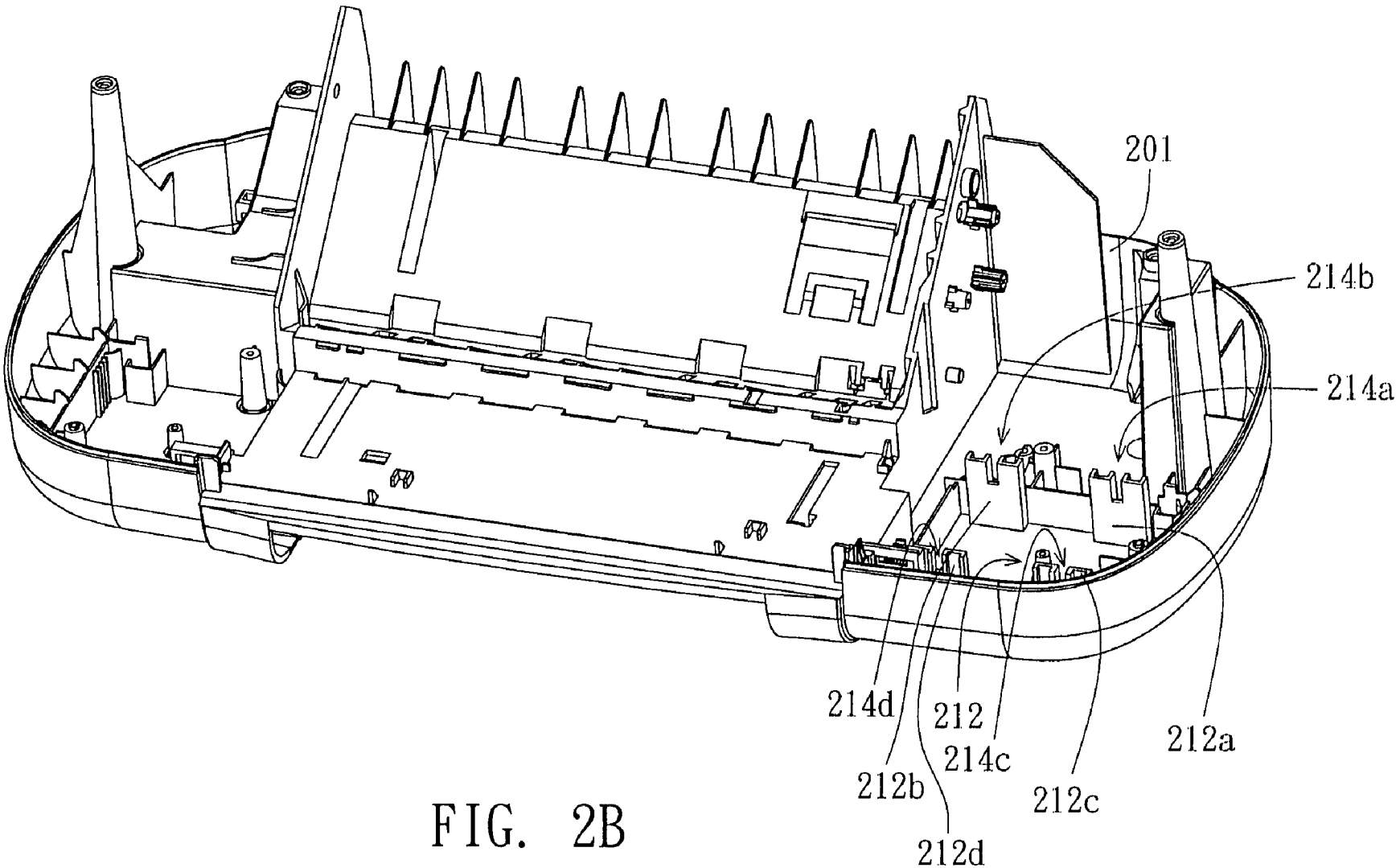
FIG. 2B illustrates a perspective of a slide track and a fillister.
Figure 2C:
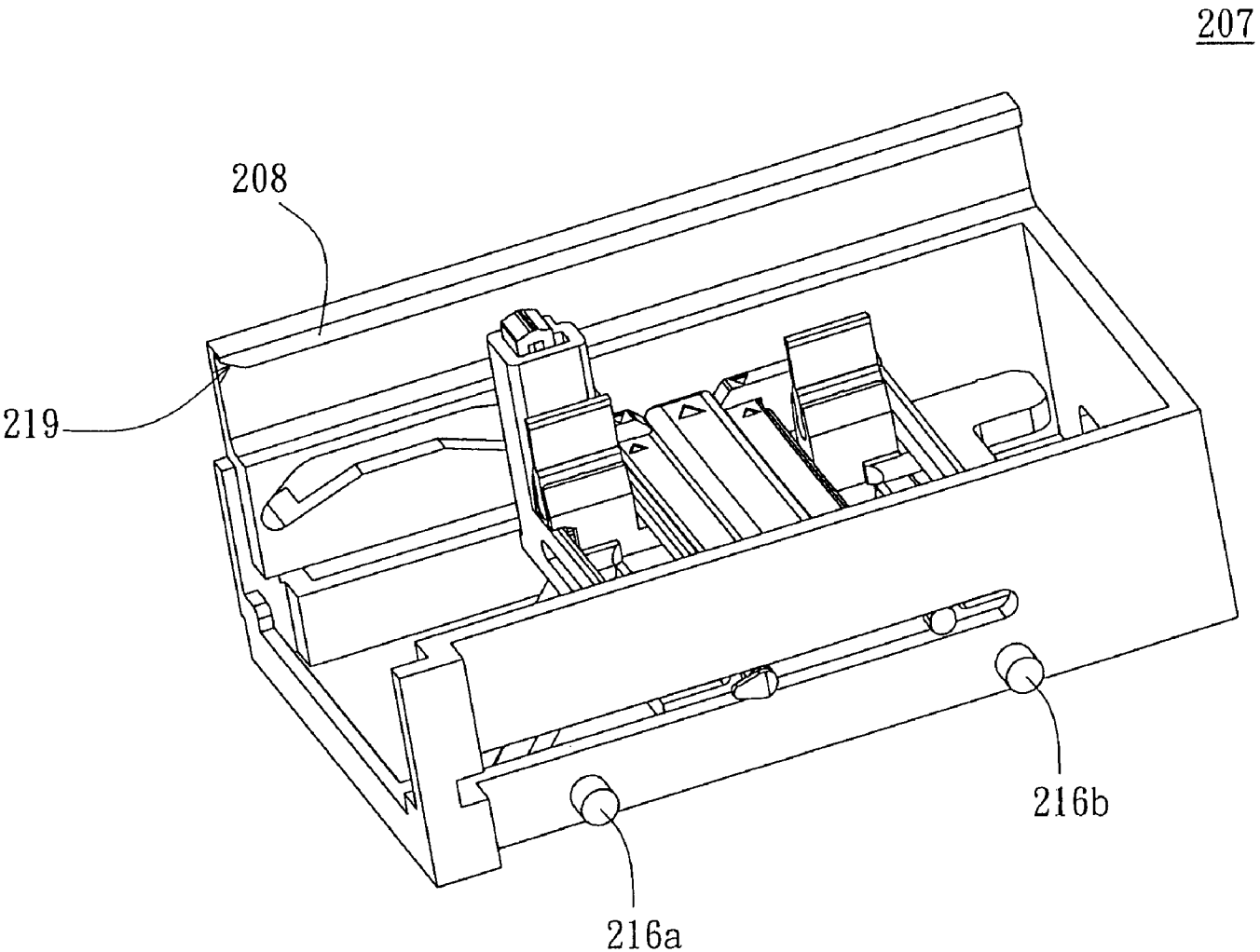
FIG. 2C illustrates a perspective of a clean housing.
Figure 2D:
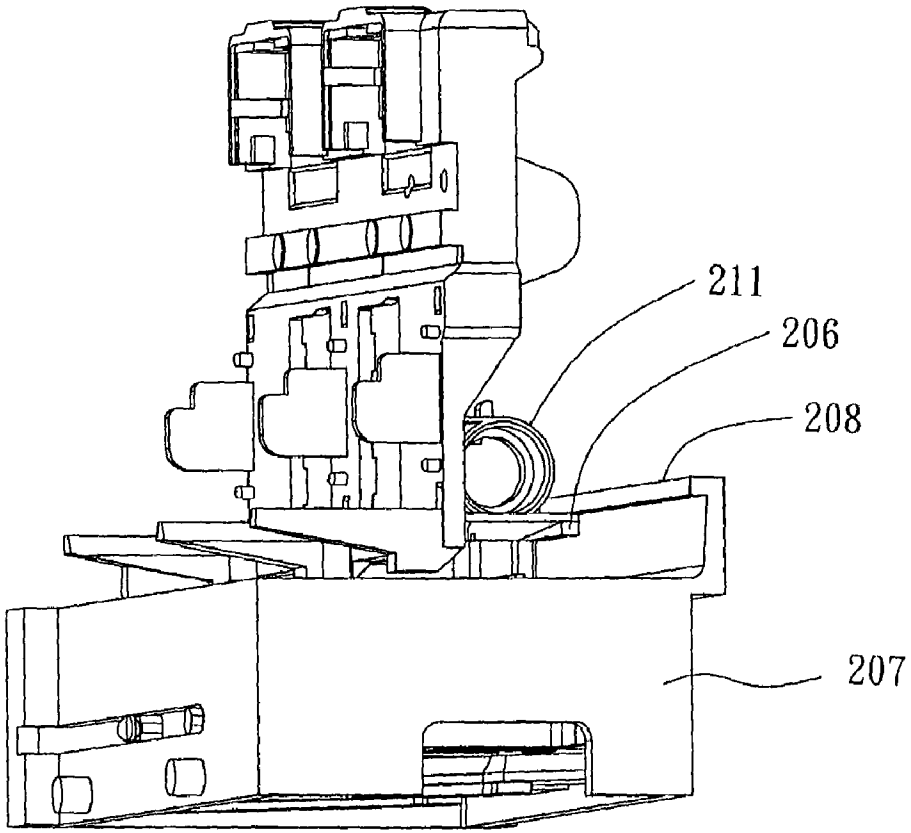
FIG. 2D illustrates a perspective of a carrier and a clean housing.

Referring to FIG. 2B, a perspective of a slide track and a fillister is shown. A number of fillisters 212 are disposed on the housing 201 of the printer. The fillister 212 has a number of fixing plates, such as fixing plates 212*a*, 212*b*, 212*c* and 212*d*, disposed thereon. Each fixing plate has a slide track disposed thereon. For example, the fixing plates 212*a*, 212*b*, 212*c* and 212*d* respectively have slide tracks 214*a*, 214*b*, 214*c* and 214*d* disposed thereon. Referring to both FIG. 2C and FIG. 2D. FIG. 2C illustrates a perspective of a clean housing, while FIG. 2D illustrates a perspective of a carrier and a clean housing. The fillister 212 is used for accommodating a clean housing 207. A number of protrusions 216 such as protrusions 216*a*, 216*b*, 216*c* and 216*d* (the protrusions 216*c* and 216*d* are not shown in FIG. 2C) are disposed outside the clean housing 207. The protrusions slide on the slide tracks. Since a slide track limits the movement path of a protrusion, the clean housing 207 is able to smoothly move upward or downward along the slide tracks 214*a*, 214*b*, 214*c* and 214*d* without tilting during the course of movement. A slide groove 208 is disposed on the clean housing 207. The carrier 205 has a protruding portion 206 disposed thereon. The protruding portion 206 is engaged with the slide groove 208 to drive the clean housing 207 to move upward or downward.

Figure 2E:
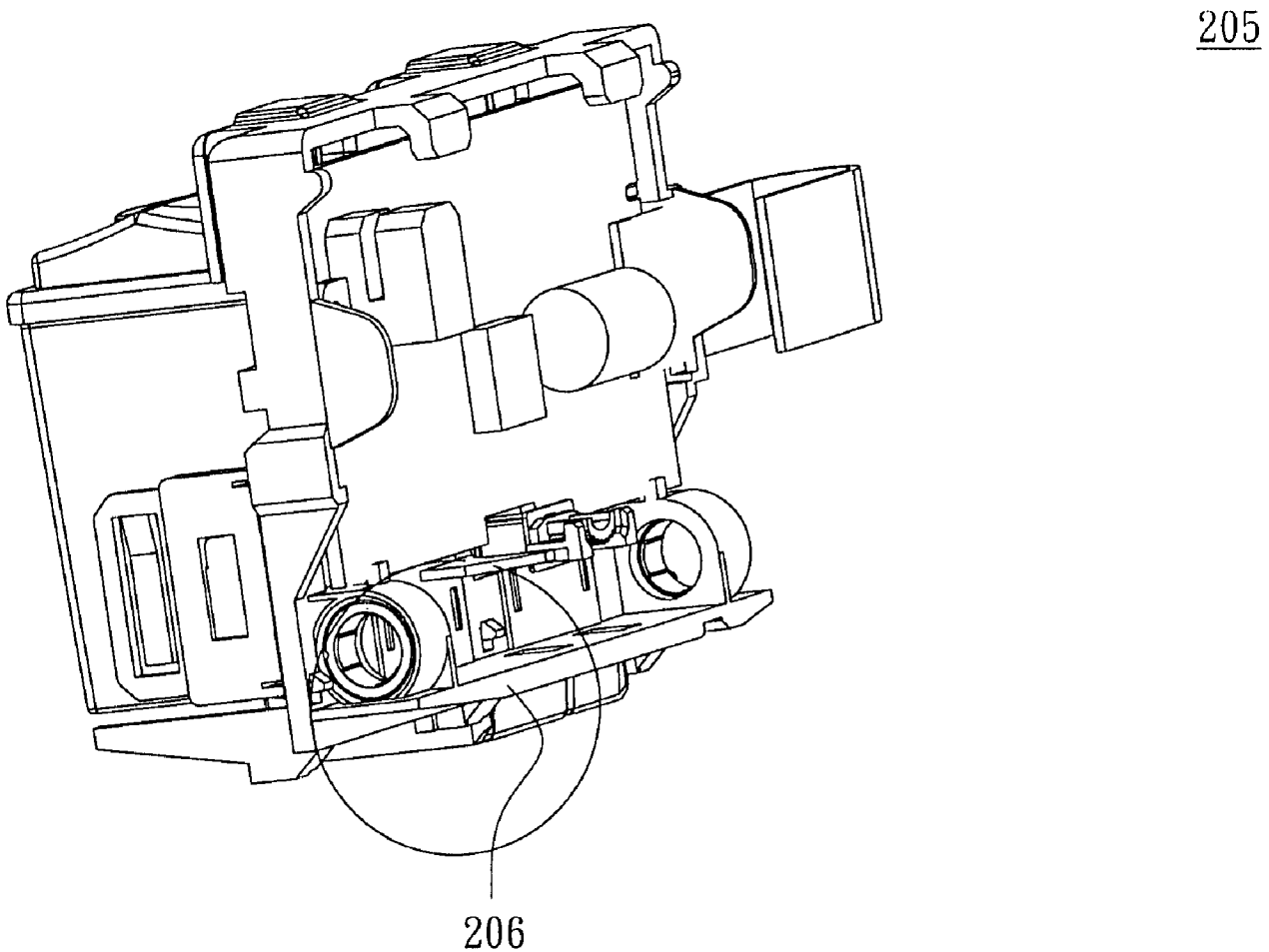
FIG. 2E illustrates a rear perspective of the carrier.
Figure 2F:
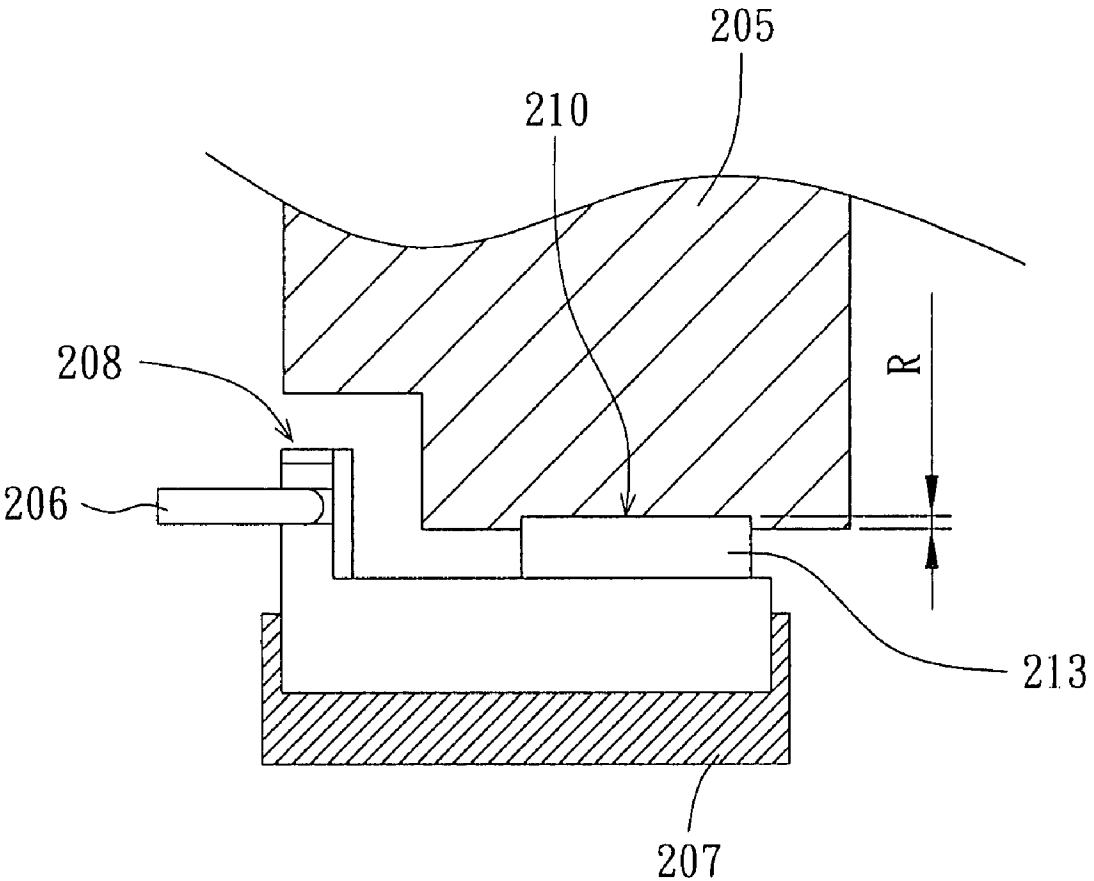
FIG. 2F illustrates a partial cross-sectional diagram before the clean housing is driven by the carrier.

Referring to FIG. 2A, FIG. 2B, FIG. 2E and FIG. 2F at the same time. FIG. 2E illustrates a rear perspective of the carrier. FIG. 2F illustrates a partial cross-sectional diagram before the clean housing is driven by the carrier. If the printing paper of the printer is a Plain Paper whose thickness is 0.12 mm, the height of the carrier 205 is at its lowest, but the clean housing 207 is still positioned in fillister 212 without moving. Therefore, an optimum interference distance R exists between the cleaner 213 disposed on the clean housing 207 and the print head 210 disposed on the carrier 205. The interference distance R is the overlapping height between the cleaner 213 and the print head 210 when the cleaner 213 reaches the best effect of cleaning the print head 210.

However, the user may not always use the printing paper of the same thickness. For example, when the user would like to print with Photo Paper, whose thickness is 0.25 mm, the height of the carrier 205 needs to be adjusted accordingly to assure the quality of printing. Take the present embodiment of the invention for example, the height needs to be adjusted by 0.13 mm (0.25−0.12=0.13 mm). In the present embodiment of the invention, the protruding portion 206 illustrated in FIG. 2D and FIG. 2E is engaged with the slide groove 208 illustrated in FIG. 2C and FIG. 2D. The height of the clean housing 207 and the height of the carrier 205 are adjusted at the same time to achieve a thorough cleaning. For the carrier 205 to smoothly drive the clean housing 207 to move, the slide groove 208 disposed on the clean housing 207 is equipped with a ramp 219. As for how the carrier 205 drives the clean housing 207 for the height of the clean housing 207 and the height of the carrier 205 to be adjusted synchronously is disclosed below.

Figure 2G:
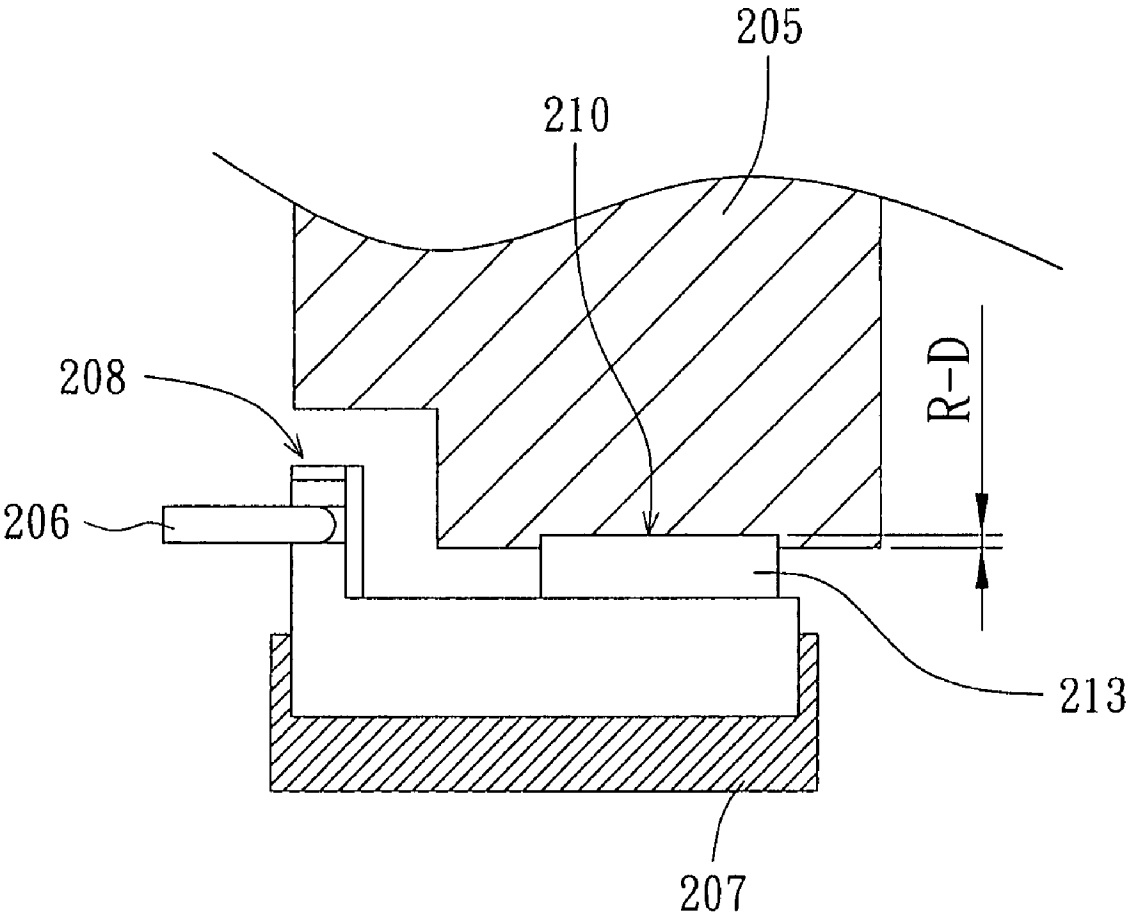
FIG. 2G to FIG. 2K are diagrams illustrating the height of the clean housing being raised along with the carrier.
Figures 2H, 2I, 2J:
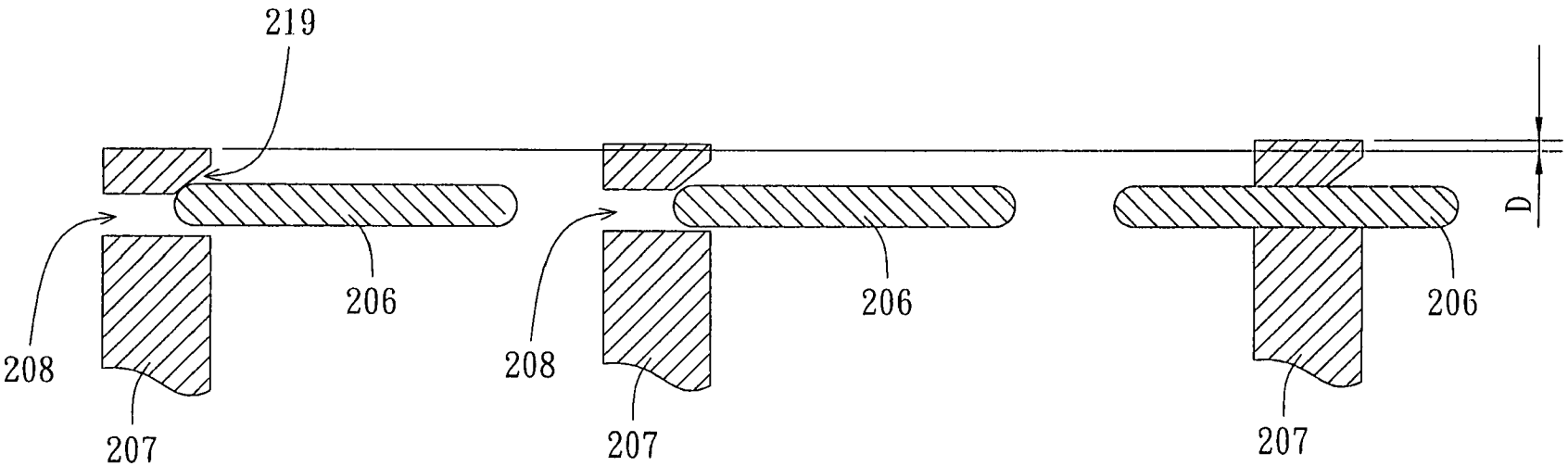
Figure 2K:
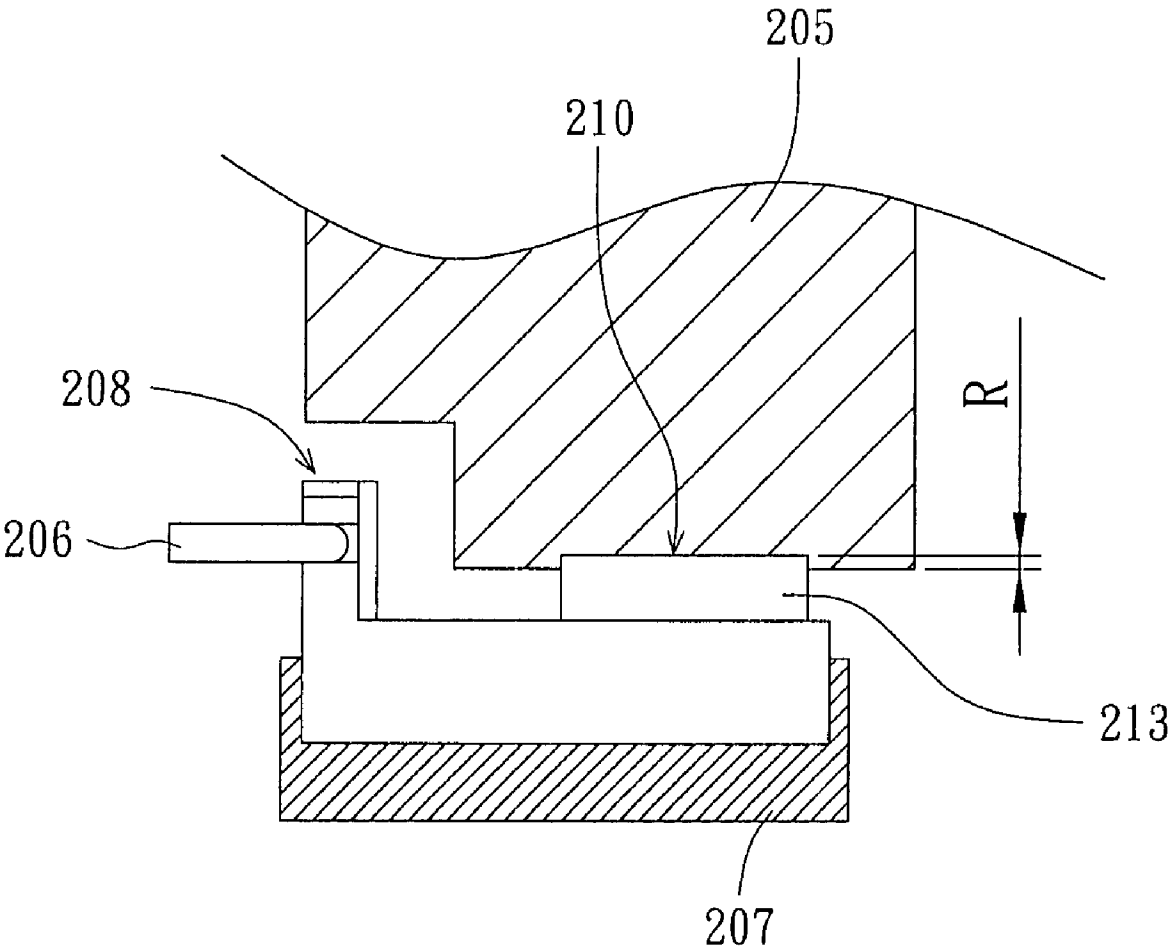

Referring to FIG. 2G to FIG. 2K, diagrams illustrating the height of the clean housing being raised along with the carrier are shown. As shown in FIG. 2G, if the carrier 205 is raised up by distance D (0.13 mm) but the clean housing 207 is not raised up together, the interference distance between the print head 210 and the cleaner 213 would be reduced to R-D. As a result, the overlapping height is lowered, and an excellent cleaning effect can not be achieved. The reason why the slide groove 208 is disposed on the clean housing 207 is that when the height of the carrier 205 changes, the height of the clean housing 207 will be raised up synchronously. In FIG. 2H to FIG. 2K, when the height of the carrier 205 is raised up, the protruding portion 206 of the carrier 205 will be engaged with the slide groove 208 to drive the clean housing 207 to increase the distance D for the interference distance R between the print head 210 and the cleaner 213 to be maintained at a fixed value. Therefore, regardless of whatever type of the printing paper is used, the distance between the cleaner 213 and the print head 210 can be fixed at the interference distance R to assure an excellent cleaning effect. In the first embodiment, the slide groove 208 and the protruding portion 206 form a sliding contact for the protruding portion 206 to be slidden into the slide groove 208 to drive the clean housing 207. For the protruding portion 206 to be smoothly engaged with the slide groove 208, a ramp 219 is disposed on the slide groove 208. The width at the opening of the ramp 219 is larger than the thickness of the protruding portion 206 for the protruding portion 206 to be smoothly slidden into the slide groove 208 along the ramp 219. Meanwhile, one end of the protruding portion 206 is arced in correspondence to the slope of the ramp 219 for enabling the protruding portion 206 to be smoothly engaged with the slide groove 208. Therefore, with the disposition of the ramp 219, the present embodiment of the invention enables the protruding portion 206 to smoothly raise the protruding portion 206 and the entire clean housing 207.

Second Embodiment

Unlike the sliding contact between the protruding portion and the slide groove in the first embodiment, the contact between the protruding portion and the slide groove can be rolling contact in the second embodiment. The present embodiment involves two cases.

Figures 3A, 3B, 3C:
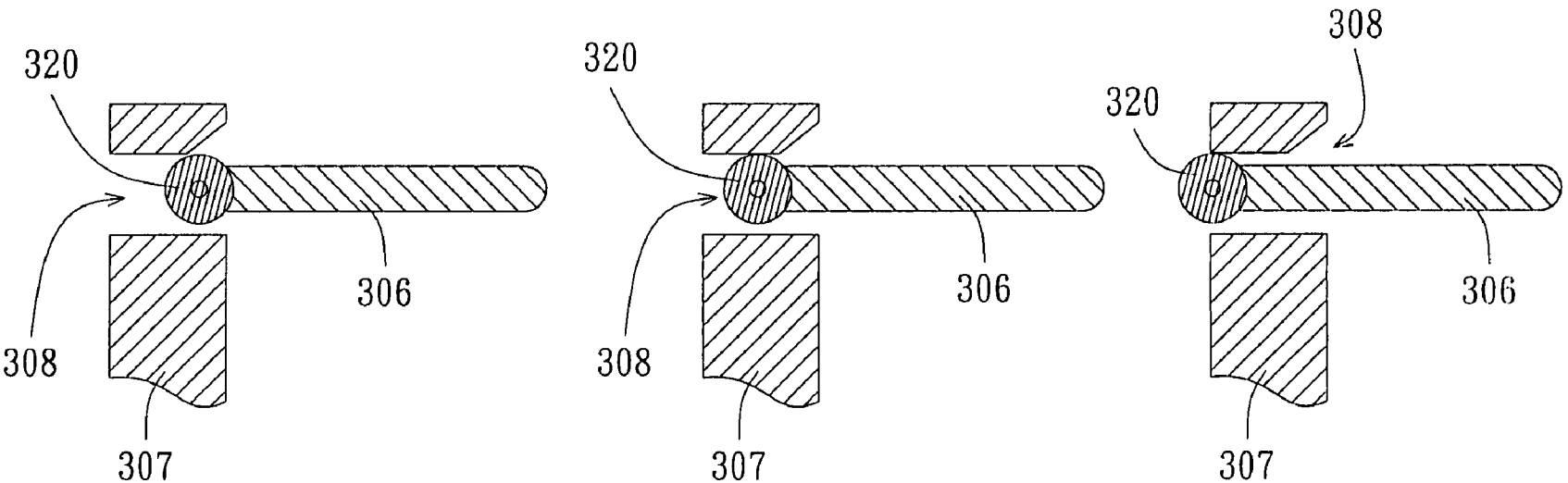
FIG. 3A to FIG. 3C illustrate a protruding portion with a roller being engaged with a slide groove; and FIG. 4A to FIG. 4C illustrates a slide groove with a roller.

Referring to FIG. 3A to FIG. 3C, diagrams illustrating a protruding portion with a roller being engaged with a slide groove are shown. In the case of rolling contact, the first case is that a roller 320 is disposed at the terminal end of the protruding portion 306 for the protruding portion 306 and the slide groove 308 to have a smoother contact and produce a better effect in driving the carrier 305.

Figure 4C:
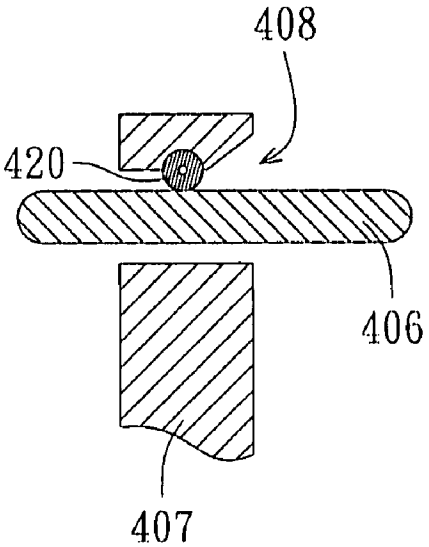
Figure 4B:
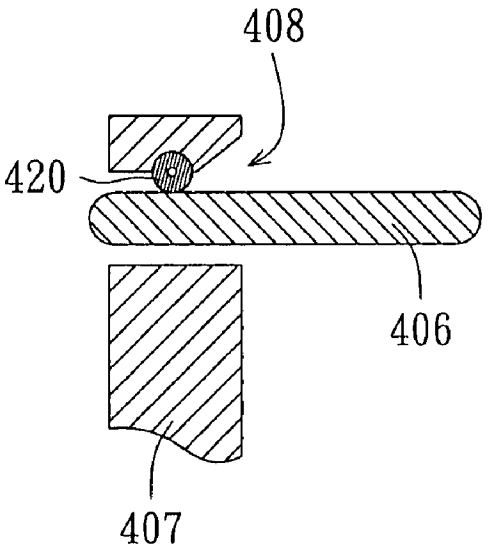
Figure 4A:
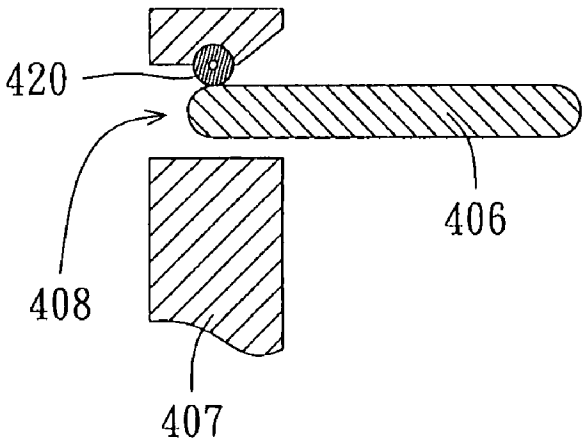

Referring to FIG. 4A to FIG. 4C, diagrams illustrating a slide groove with a roller are shown. The second case also occurs to the rolling contact except that in FIGS. 4A to 4C, the roller 420 is disposed in the slide groove 408, not on the protruding portion 406. Both cases are aimed to make the protruding portion easily and smoothly drive the clean housing when rolling contact exists between the protruding portion and the slide groove. The above embodiments are exemplified by a round shaft. However, in the case of a printer adopting an eccentric shaft, the clean housing can be directly connected to the eccentric shaft. When the eccentric shaft rotates, the carrier will move upward or downward correspondingly to maintain a fixed pen-to-paper space (PPS) so that the printing quality of the printer is assured. Meanwhile, the clean housing also moves upward or downward accordingly to maintain a fixed interference distance between the cleaner and the print head for enabling the cleaner to clean the print head thoroughly. However, the printer adopting an eccentric shaft can choose to clean the print head by the abovementioned structure instead of directly connecting the clean housing to the eccentric shaft.

As is disclosed in the above embodiments, through prior calculation and design, the clean housing of a printer, without electronically controlling the height of the clean housing, is capable of mechanically adjusting the height of the clean housing according to the thickness of the paper for the distance between the cleaner and the print head to be maintained at an optimum interference distance. As a result, an excellent cleaning effect is achieved, and an optimum printing quality is maintained.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A printer, comprising:

a housing;

a round shaft disposed in the housing;

a carrier reciprocally disposed on the round shaft, wherein the carrier is used for carrying a cartridge; and a clean housing equipped with a cleaner, wherein the cleaner is used for cleaning a print head of the cartridge;

wherein when the carrier moves upward or downward, the carrier mechanically drives the clean housing to move upward or downward to maintain a fixed interference distance between the cleaner and the print head for enabling the cleaner to clean the print head.

2. The printer according to claim 1, wherein the clean housing further has a slide groove, the carrier further comprises a protruding portion, and the protruding portion is engaged with the slide groove to drive the clean housing to move upward or downward.

3. The printer according to claim 2, wherein the slide groove has a ramp for enabling the protruding portion to be smoothly engaged with the slide groove.

4. The printer according to claim 3, wherein a width at an opening of the ramp is larger than a thickness of the protruding portion.

5. The printer according to claim 3, wherein one end of the protruding portion is arced in correspondence to a slope of the ramp.

6. The printer according to claim 2, wherein the slide groove and the protruding portion form a sliding contact.

7. The printer according to claim 2, wherein the slide groove and the protruding portion form a rolling contact.

8. The printer according to claim 7, wherein the slide groove further has a roller for the slide groove and the protruding portion to form the rolling contact.

9. The printer according to claim 7, wherein the protruding portion further has a roller for the slide groove and the protruding portion to form the rolling contact.

10. The printer according to claim 1, wherein the carrier further comprises a pipe disposed on the round shaft to drive the carrier to reciprocate along the round shaft.

11. The printer according to claim 1, further comprising a fillister for accommodating the clean housing.

12. The printer according to claim 11, wherein the fillister comprises a plurality of fixing plates having a plurality of slide tracks disposed thereon.

13. The printer according to claim 12, wherein a plurality of protrusions disposed outside the clean housing move between the slide tracks for enabling the clean housing to move upward or downward smoothly.

* * * * *